US005273271A

United States Patent [19]

Intemann

[11] Patent Number: 5,273,271

[45] Date of Patent: Dec. 28, 1993

[54] PAPER TRAY DETECTOR SYSTEM

[76] Inventor: Eric F. Intemann, 700 Lake Dr., #140, Orange, Calif. 92666

[21] Appl. No.: 51,188

[22] Filed: Apr. 8, 1993

[51] Int. Cl.[5] ..... B65H 1/04

[52] U.S. Cl. ..... 271/145; 206/449

[58] Field of Search ..... 271/3.1, 145, 157, 162, 271/164; 206/449

[56] References Cited

U.S. PATENT DOCUMENTS 5,067,835 11/1991 Yamamoto ..... 271/145 X 5,100,122 3/1992 Noda ..... 271/145 X

FOREIGN PATENT DOCUMENTS 153742 9/1984 Japan ..... 271/145

102336 6/1985 Japan ..... 271/145

197232 8/1989 Japan ..... 271/145

*Primary Examiner*—Richard A. Schacher

*Attorney, Agent, or Firm*—G. Donald Weber, Jr.

[57] ABSTRACT

An accessory which is used with paper tray devices or cassettes which are used with printers and printing devices associated with computing systems and the like. The detector operates to provide an alarm signal when the tray or cassette is empty of paper.

5 Claims, 1 Drawing Sheet

PAPER TRAY DETECTOR SYSTEM

BACKGROUND

1. Field the Invention

This invention is directed to a detector associated with a paper feeding mechanism, in general, and to a detector which signals that a paper feeding tray or cassette is empty, in particular.

2. Prior Art

With the advent of the computer age and, more importantly, the personal computer explosion, more and more uses are being found for printing devices. The devices are used as an adjunct to the computing system to produce the hardcopy output.

As computers achieve higher operating speeds, the printing devices operate faster, as well. In many instances, the printing device is a laser printer which is capable of printing a large number of sheets in a very short period of time. For example, it is not at all unusual to find laser printers which can print 8 to 16 pages per minute. This equates to a page every four to eight seconds. Obviously, higher speed capablities are permissible and expected.

In conjunction with many such printers, the paper to be printed upon is provided in trays or cassettes. The trays or cassettes permit the printer to be used with different types of paper, different sizes of paper and so forth. That is, one cassette may be used for $8\frac{1}{2}\times 11$ paper, another cassette may be used for $8\frac{1}{2}\times 14$ paper and so forth. The use of the cassettes permits quick and easy interchange and replacement of paper in the printer.

Of course, the trays or cassettes tend to have a relatively limited amount of paper therein. Consequently, with the high-speed printing capabilities of the printing apparatus, the cassette must be monitored and the supply of paper replenished. In the event that the paper is not replenished in a timely fashion, a great deal of inefficient operation of the computer can be encountered because of having to retrace the steps of the machine to determine when printing terminated (because of lack of paper) and to reinitiate the cycle. Because of the high speeds noted above, it is sometimes difficult to monitor the paper supply in the cassette. In addition, because of the high speed of operation, it is difficult to keep the paper supply replenished while conducting other activities with regard to the computing system. Consequently, it is highly desirable to have a means for detecting when the paper in the tray or cassette has run out. There are many techniques known for other types of printing devices, such as printing presses or the like. These devices usually indicate a break in the paper which is mechanically detected. These types of detectors usually operate to shut down the system automatically. These systems are usually operative in terms of a continuous web of paper being passed through the system wherein a tension detection device is utilized.

However, such systems are usually quite expensive and highly interruptive in the printing process because of shutting down the entire system. Moreover, the cost involved in such a device is usually prohibitive relative to the costs of the computer and printer systems used in most personal computer applications.

It is, therefore, highly desirable to have some alarm system which indicates the status of the paper supply in the paper tray or cassette. With respect to smaller-size printers, there are specific detector units or devices. For example, some printers include visual indicators which light or flash when the paper supply cassette is empty. Unfortunately, this indicator is frequently overlooked by the printer operator.

Some very sophisticated devices include a software package which keeps track of the paper supply and warns the operator when the supply is low or exhausted.

SUMMARY OF THE INSTANT INVENTION

This invention is directed to a detector device which is readily and easily mounted into existing paper trays or cartridges which are used with printers, in particular laser printer devices. The detector does not utilize any space currently not available in the tray or cassette. Consequently, it is unnecessary to redesign the tray or cassette.

The detecting device includes a sensing arm which is arranged to repose on the paper stored in the tray. When the paper supply is exhausted, the sensor arm contacts the bottom of the tray and causes an electrical signal to be generated in the alarm circuit in the detector. The detector then produces an alarm signal which can be a beep, a ping or any other suitable tone of any desired frequency. The amplitude of the tone is sufficient to be heard by the operator of the printing device. The tone indicates the lack of paper in the tray.

When the new paper supply is inserted into the tray, the sensor arm is rotated to engage a contact on the sensor device which, in essence, resets the circuit in the detector so that the alarm signal is discontinued.

The sensing arm is then replaced on top of the paper supply ready to repeat the process.

DESCRIPTION OF A PREFERRED EMBODIMENT

Figure 1:
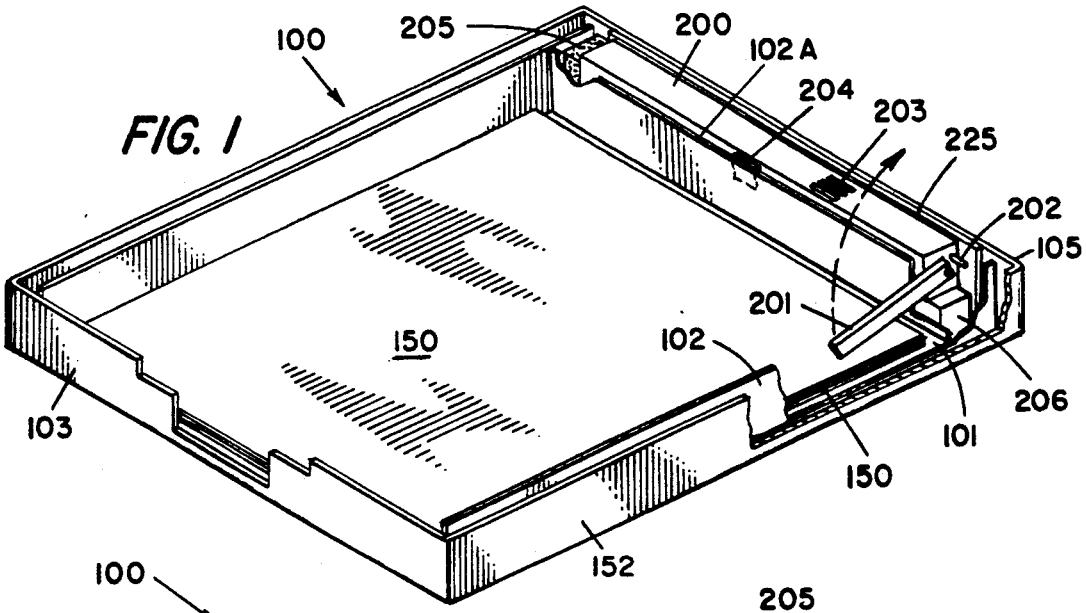
FIG. 1 is a partially broken-away, isometric view of a typical paper tray with the detector of the instant invention mounted therein.
Figure 2:
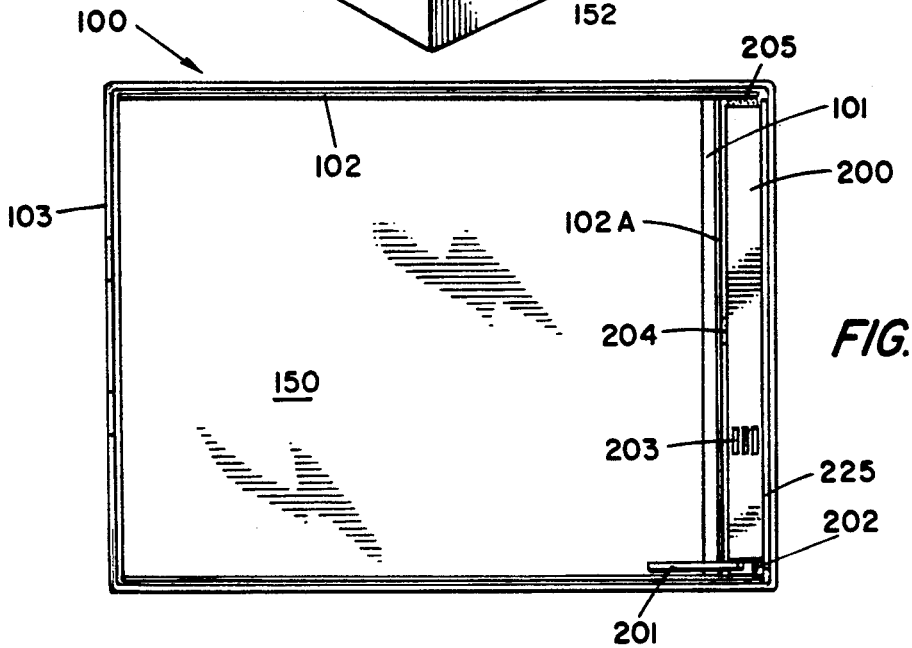
FIG. 2 is a plan view of the detector and tray assembly shown in FIG. 1.

Referring now to FIGS. 1 and 2 concurrently, there is shown an assembly of a tray 100 and a detector 200. The tray 100 is of conventional configuration and construction. The tray, which is adapted to contain a supply of paper sheets, includes a flat bottom which is, typically, a metal plate 101. In many cases, the plate 101 is aluminum or other lightweight material. However, the type of metal used is not significant to the invention. In fact, the lower plate 101 need not be a continuous or uniform sheet of metal. It is sufficient that the metallic portion of the plate be electrically conductive and interact with the detector as described hereinafter.

In addition, the tray 100 includes upright walls 102 which form a space or chamber for storing therein a quantity of paper 150. The upright walls 102 are comprised of at least one wall which is metallic or at least an electrically conductive wall 102A, as shown. The electrically conductive wall 102A is adjacent the rearward extremity of the tray 100. The paper 150 is retained by the walls 102 and moves outwardly from the front end 103 of the tray 100 in a conventional manner. As noted, the rear wall 102A is electrically conductive and is electrically connected to the tray bottom 101.

The remainder of the tray 100 is conventional. A detailed discussion of the outer walls 152, which may be plastic, and the inner walls 102, which may be metal or plastic, is deemed unnecessary. The tray 100 is not a portion of the invention, per se, although the detector 200 interacts therewith.

The detector 200 is an elongated, generally rectilinear housing or unit which is constructed and arranged to fit between the outer back wall 105 of the tray and the inner back wall 102A of the tray. (The inner and outer walls 102 and 105, respectively, are, typically, pre-existing walls of the conventional tray 100.)

The detector 200 has an outer housing which is generally hollow to contain the detector circuitry, alarm and other apparatus. In a typical embodiment of the detector 200, the housing is formed of a relatively strong, non-conductive plastic material. At one end of the detector housing 200 is a compressable, foam or rubber end member 205. This member is provided to assure that detector 200 fits snugly into the space between the end walls or back walls 102 and 105 of the tray. In addition, the end member 205 creates a snug fit at the end of the detector so that it remains in place when tray 100 is moved or adjusted.

At the other end of the detector 200 is a pivotally mounted arm 201 which is mechanically connected to the detector 200 and pivots around an appropriate pin, rivet or the like. The arm 201 is fabricated of a metal or other electrically conductive material. The arm is arranged to rest on the paper supply 150 in the tray chamber. In addition, when the paper supply 150 is depleted, the arm 201 is able to rotate and rest upon the bottom plate 101 in order to make electrical contact therewith.

In addition, at the same end of the detector 200, and adjacent to the pivotally mounted arm 201, is pin 202 which extends outwardly from the end of the detector 200. The pin 202 is mounted adjacent to the pivoting end of arm 201. Thus, the arm 201 can be selectively pivoted (see arrow 250) until it contacts pin 202. As will become apparent, infra, the arm 201 normally rests on the paper supply 150 but, alternatively, makes electrical contact with the metal base 101 (when the paper supply is depleted) and with the pin 202 when the alarm system of the detector is to be reset.

The detector 200 includes a metal contact plate 204 which extends outwardly from one surface of the detector 200 and is placed in electrical contact with the end plate 102. Typically, the contact 204 may be spring-loaded so as to assure contact with end plate 102.

An aperture 203 (or a plurality of apertures) is provided in one surface of detector 200. The apertures are located adjacent to an alarm device (see FIG. 3) mounted within detector 200. Thus, when the alarm device provides the appropriate audible signal, the signal is projected through the apertures 203 into the ambient.

Referring specifically to FIG. 2, there is shown a spacer strip 225, which is disposed between the back edge of detector 200 and the back wall 105 of the tray 100. The spacer strip 225 is, typically, a thin strip of plastic which can be selectively adhered to the back surface of detector 200. The spacer strip 225 is used only in those cases where the space between the back walls 102 and 105 is somewhat farther apart than in other cases. That is, if the detector 200 fits snugly between the walls 102 and 105 without the spacer 225, the spacer may be omitted.

Also, as seen best in FIG. 1, the detector 200 may include an offset portion 206 adjacent to the pivoting arm 201 and the reset pin 202. This offset, step-like portion permits the detector 200 to butt up against the side wall to assure a reasonable friction fit without interfering with the operation of the arm 201 or the pin 202.

Thus, there is shown a conventional tray 100 which includes upright walls 102, 102A, 103, 105 and the like. It also includes a metallic base plate 101. The detector 200 is inserted into the existing space between the rear walls 102A and 105 so that the construction of the tray need not be altered in any fashion.

Figure 3:
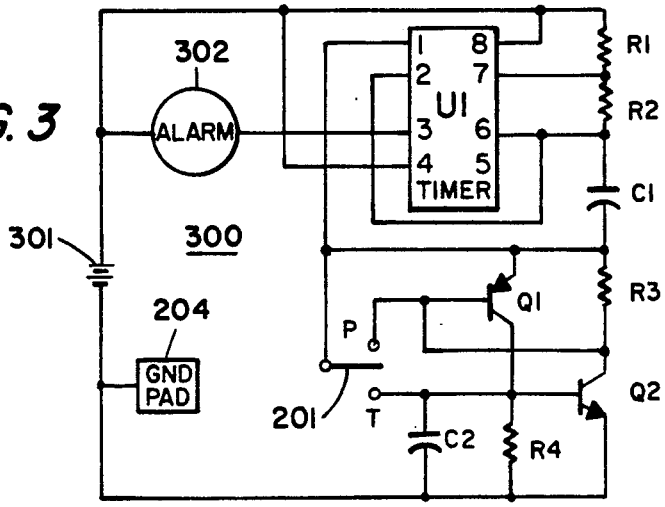
FIG. 3 is a schematic diagram of a representative alarm circuit which is used in the invention.

Referring now to FIG. 3, there is shown a schematic diagram of a preferred embodiment of the detector circuit 300 of the instant invention.

The circuit 300 includes a source 301 which can take the form of an alkaline battery or any other suitable energy source. The negative terminal of the battery 301 is connected to the ground pad or connector contact 204 (see FIGS. 1 and 2). The contact 204 is arranged to make electrical contact with the tray 100 to establish a "system ground".

The positive terminal of battery 301 is connected to one terminal of alarm 302. The alarm 302 can take any form of alarm such as an audible, sound-producing device in the nature of a buzzer or the like. Alternatively, the alarm can take the form of a light-producing device or the like. In some cases, the alarm can be a combination of audible and visual alarm devices.

In the instant embodiment, the timer U1 is a monolithic timing circuit which is capable of producing accurate time delays and/or signal oscillation. A typical component is a Texas Instruments SE 555 precision timer. In this invention, the device is used in the astable mode of operation wherein the frequency and duty cycle are controlled by resistors R1, R2 and capacitor C1.

In addition, the circuitry is controlled by transistors Q1 and Q2 connected in a regenerative switching configuration. In this instance, transistor Q1 is a PNP type transistor while transistor Q2 is an NPN type transistor.

Resistor R3 is connected between the base and emitter electrodes of transistor Q1 and operates as a bias resistor therefor. In addition, resistor R3 is connected to the collector electrode of transistor Q2 and operates as the load resistor therefor.

Resistor R4 is connected between the base and emitter electrodes of transistor Q2 and operates as a bias resistor therefor. In addition, resistor R4 is connected to the collector electrode of transistor Q1 and operates as the load resistor therefor.

A bypass capacitor C2 is connected across resistor R4.

The switching arm 201 is selectively connected to the base electrode of transistor Q1 and collector electrode of transistor Q2 (at terminal P) and the base electrode of transistor Q2 and collector electrode of transistor Q1 (at terminal T). The terminal P represents the pin 202 in FIGS. 1 and 2 while the terminal T represents the tray plate 101 in FIGS. 1 and 2.

As noted supra, transistors Q1 and Q2, together with the associated components, form a regenerative switching circuit. When switching arm 201 contacts terminal T, a positive voltage is applied to the base electrode of transistor Q2. Transistor Q2 is then turned ON and causes current flow through resistor R3 whereby transistor Q1 is turned ON whereby transistor Q2 is latched in the ON condition. With transistors Q1 and Q2 turned ON, ground potential is applied to timer U1 at pins 1 and 6 (via capacitor C1). This operation causes the output at pin 2 of timer U1 to go low wherein the beeper, i.e. alarm Z1, is activated.

The activation of the alarm Z1 produces an alarm signal which indicates that the paper supply 150 is depleted and needs to be replaced. The alarm continues to produce the alarm signal until the alarm circuit is reset.

To reset the alarm circuit 300, the arm 201 is rotated around its pivot (see FIG. 1) and placed in contact with terminal P (i.e. pin 202). When arm 201 contacts terminal P (reset pin), ground potential is applied to the base electrode of transistor Q1 which is then turned OFF. Transistor Q2 is also turned OFF which latches transistor Q1 OFF. With transistors Q1 and Q2 turned OFF, the ground potential is removed from the trigger in timer U1. The potential at the output terminal (pin 3) of the timer goes high whereupon the alarm Z1 is deactivated and the circuit is reset. At this time a new supply of paper can be placed in tray 100 and the arm 201 rotated around its pivot and placed atop the paper stack. The operation of the unit is then repeated as above.

Thus, there is shown and described a unique design and concept of a sensor or detector. The particular configuration shown and described herein relates, generally, to a detector associated with a paper feeding mechanism and, in particular, to a detector which provides signals which indicate that a paper feeding tray or cassette is empty. Of course, any other product can be detected. Moreover, by changing certain polarities, the detector can monitor a supply of conductive materials. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A paper detector adapted to be inserted into an existing paper supply tray comprising,
   a housing,
   a detector circuit mounted within said housing,
   a reset terminal mounted on said housing, and
   a rotatable contact arm mounted on said housing and adapted to selectively contact said supply tray to activate said detector circuit and said reset terminal to deactivate said detector circuit.

2. The detector recited in claim 1 including,
   alarm means connected to said detector circuit,
   said alarm means rendered operative when said detector circuit is activated.

3. The detector recited in claim 1 including,
   contact means provided in said housing,
   said contact means adapted to engage said tray means.

4. The detector recited in claim 1 including,
   oscillator means which is operative to produce oscillation signals when said detector circuit is activated.

5. The detector recited in claim 1 wherein,
   said housing is mounted adjacent one end of said supply tray.

* * * * *